US005301398A

United States Patent [19]

Bursey, Jr.

[11] Patent Number: 5,301,398

[45] Date of Patent: Apr. 12, 1994

[54] PLASTIC BODY CONTAINER

[76] Inventor: Paul Bursey, Jr., Rte. 4, Box 190, Star City, Ark. 71667

[21] Appl. No.: 839,548

[22] Filed: Feb. 18, 1992

[51] Int. Cl.[5] ..... A61G 17/00

[52] U.S. Cl. ..... 27/7; 27/8

[58] Field of Search ..... 27/2, 3, 4, 6, 7, 8

[56] References Cited

U.S. PATENT DOCUMENTS

| | | | |
|---|---|---|---|
| 1,622,777 | 3/1927 | Fleeman | 27/7 X |
| 1,807,610 | 6/1931 | Williams et al. | 27/8 |
| 3,159,901 | 12/1964 | Harrington et al. | 27/8 X |

FOREIGN PATENT DOCUMENTS

| | | | |
|---|---|---|---|
| 75739 | 3/1919 | Australia | 27/8 |

*Primary Examiner*—Richard E. Chilcot, Jr.

*Attorney, Agent, or Firm*—Warren H. Kintzinger

[57] ABSTRACT

A primarily plastic cadaver container is molded in the form of caskets, coffins, sarcophagues, mummy shaped containers, etc., produced from primarily plastic and other materials. While all the plastic can be new virgin plastic in most instances it can, advantageously, be reclaimed plastic even chemically contaminated plastic except for some medically contaminated and/or radioactive plastic material. The containers may be clear or opaque and have various designs included and have see through windows making opening of the container containing a body unnecessary, and the containers can be made air tight such that neither air or gas enter or escape a container. Non porous glass sheets or glass matting is used as a liner in a sealed container with a further inner liner of plastic useable to protect the inner surface of the glass sheets or glass matting used thereon.

12 Claims, 2 Drawing Sheets

PLASTIC BODY CONTAINER

Figure 2:
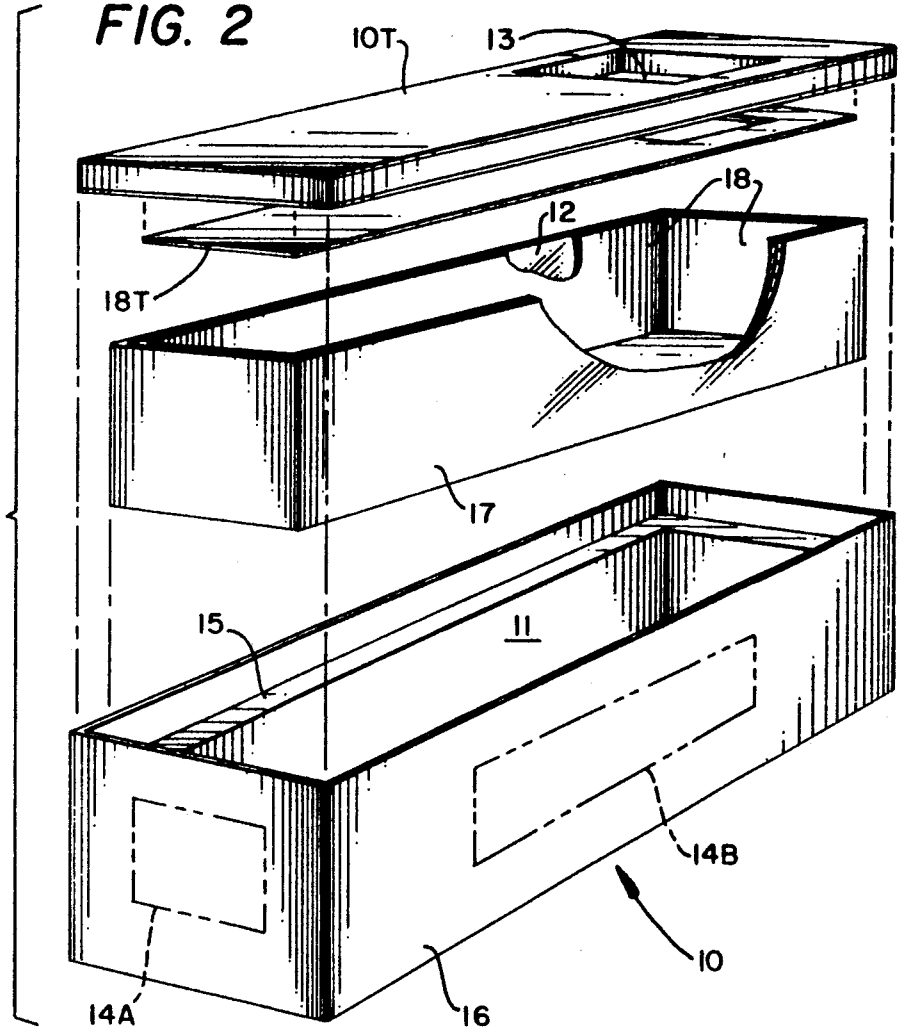

This invention relates in general to burial containers, and more particularly, to plastic body containers that are more durably long lived than metal and wood caskets and that can be made of reclaimed plastic.

Most present day burial container caskets and coffins made of metal and/or wood are subject to destructive rusting and deterioration of wood and air or gas many times can enter or escape from such burial containers. These problems can be resolved generally quite satisfactorily through the use of containers made as body containers primarily of plastic that in most instances can be reclaimed plastic. These body container products are for burial of cadavers in caskets, coffins, sarcophagus, mummy urns, cask, chest and body wrap containers. All are to be manufactured primarily from plastic and can incorporate other materials. The process can utilize most types of plastics even chemically contaminated excepting from some medically and some radioactive contaminated and all of the products can be made in various sizes and shapes, to please the customers. They may have varying designs, colors, multi-colors, inserts of varying types and shapes and descriptions. They may be clear, opaque, striped, flags, pictures, clear see through windows to preclude opening or air or gas entering or escaping. This can also provide a view of the deceased at the desire of the family or authority. Some can be equipped with support feet, and wheels, rollers and all can be permanently closed. The containers can be made totally air tight and they will last much longer than those made from wood or metal. The containers can be made as an envelope or cocoon replica of other things or of the deceased. They can be filled with plastic at the time of placement of the body within or a liquid plastic subsequent to and after permanently closing and sealing of the container lid. With the unit filled with plastic material there will be no need for a cement vault because the unit will not rot and allow the ground to sink or cave in.

The manufacturing of each unit that contains recycled plastic will consist of a center core of recycled plastic with a protective covering on both sides (inside and outside) of new plastic. For additional air and water proofing a glass or glass cloth liner or lamina shall be laminated to the entire interior.

It is therefore a principal object of this invention to provide body containers made of plastic that are lighter than metal and/or wood body containers.

Another object is to provide such a plastic body container that can be produced using reclaimed recycled plastic.

A further object is to provide such a plastic body container that is made to save space that can stand on end, lay on its side and also made for more than one cadaver being buried at the same time.

Still another object is to provide such a body container made primarily of plastic useable above ground in mausoleums, tombs, temples and sepulchers.

Features of the invention useful in accomplishing the above objects includes, in plastic body containers, a primarily plastic cadaver container molded in the form of caskets, coffins, sarcophagues, mummy shaped containers, etc., produced from primarily plastic and other materials. While all the plastic can be new virgin plastic in most instances it can, advantageously, be reclaimed plastic even chemically contaminated plastic except for some medically contaminated and/or radioactive plastic material. The containers may be clear or opaque and have various designs included and have see through windows making opening of the container containing a body unnecessary, and the containers can be made air tight such that neither air nor gas enter or escape a container. Non porous glass sheets or glass matting is used as a liner in a sealed container with a further liner of plastic useable to protect the inner surface of the glass sheets or glass matting used thereon.

Specific embodiments representing what are presently regarded as the best modes of carrying out the invention are illustrated in the accompanying drawings.

Figure 1:
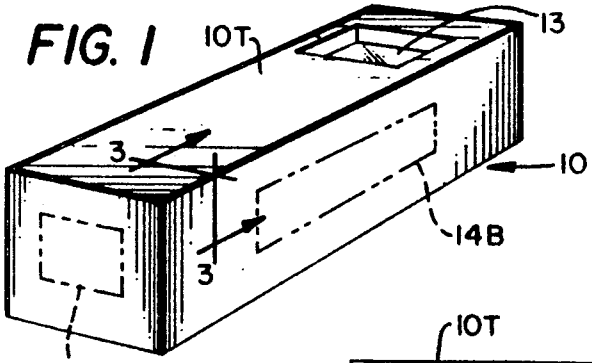
Figure 3:
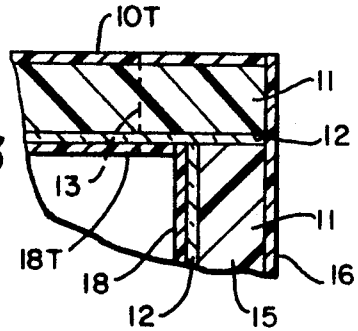
Figure 4:
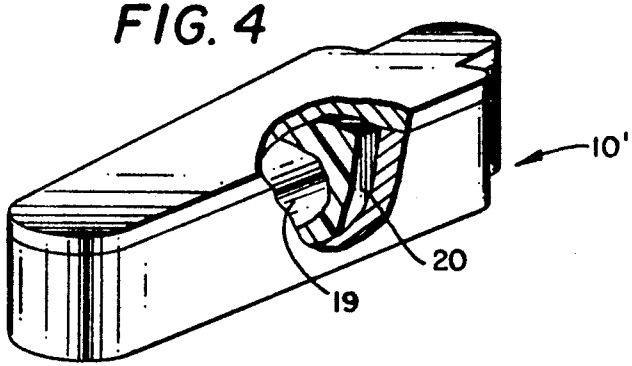

In the drawings:

FIG. 1 represents a perspective view of a closed body container with a viewing window and having emblem showings on the container;

FIG. 2, an exploded perspective view of the body container of FIG. 1;

FIG. 3, a partial cross section taken along line 3—3 of FIG. 1;

FIG. 4, a mummy shaped body container with a portion removed for interior detail.

Figure 5:
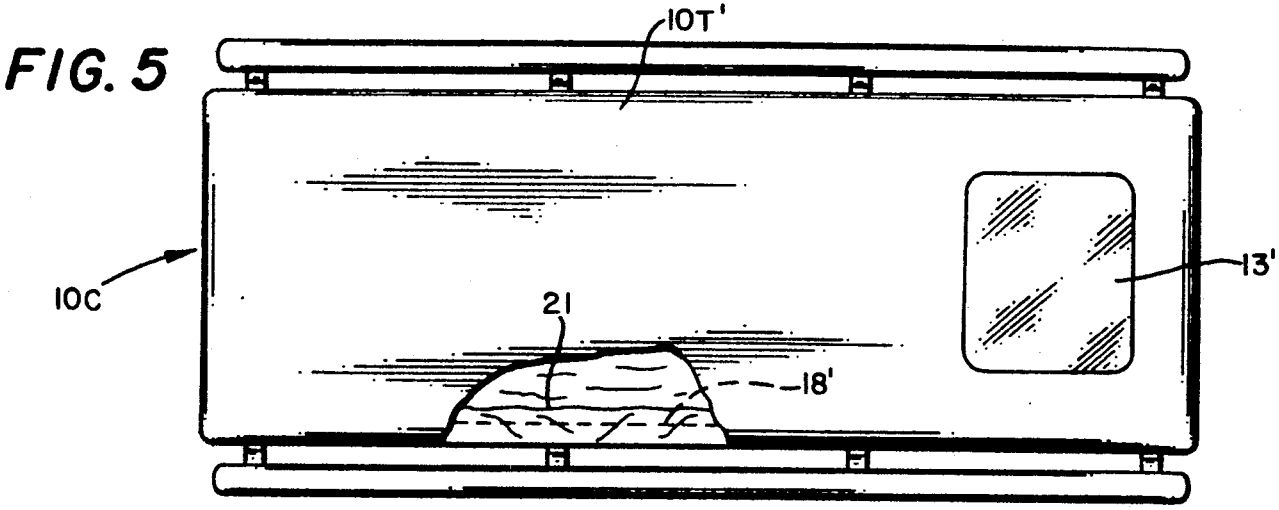
Figure 6:
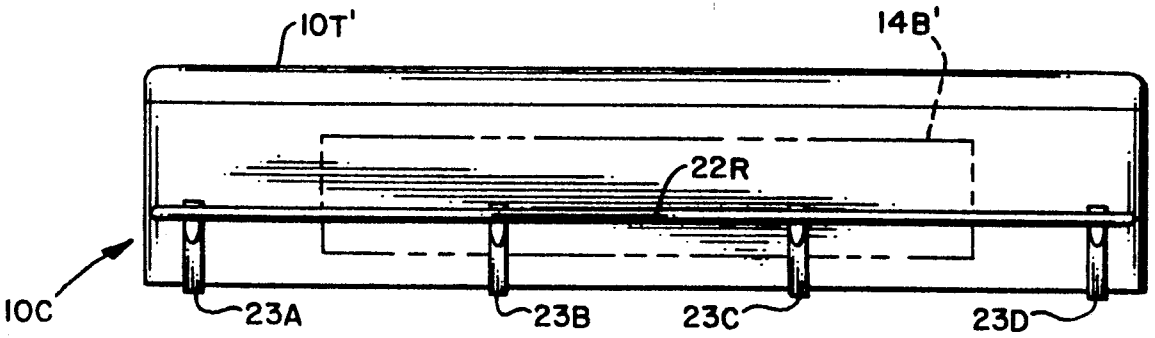
Figure 7:
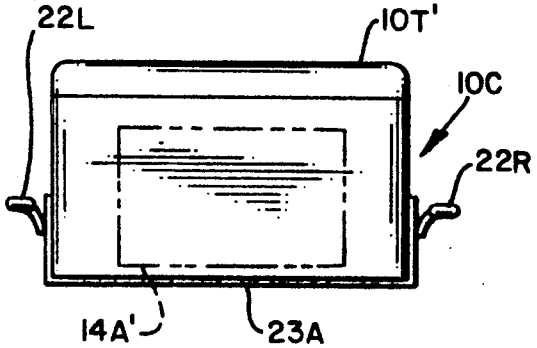

FIGS. 5, 6, and 7 respectively, the top, side and end view of a casket.

Referring to the drawings:

The body container 10 of FIGS. 1, 2, and 3 is made primarily of plastic 11 with glass sheeting or matting 12 as an aid to the overall container being substantially air tight such that neither air or gas enter or escape a container. The body container 10 is shown to be equipped with a viewing window 13 and emblems 14A and 14B on the box 10. Many other emblems could be used in addition thereto and/or in place thereof. The body container box 10 is shown to be an outer container box 10 of plastic with a main box portion 15 molded of reclaimed (recycled) plastic although it could be made of new plastic with a new plastic sheet 16 box shape on the outside of the main box portion 15. A glass material box 17 is sized to fit snugly within main box portion 15 and includes a new plastic internal sheet box 18 within the glass material box 17 as a protective inner liner therefor.

With the mummy shaped body container 10' of FIG. 4 holding a cadaver 19 liquid plastic 20 may be introduced to harden around the body 19 filling the remainder of the space within the body container.

Referring again to the body container 10 embodiment of FIGS. 1, 2 and 3 the walls of a container 10 including the top 10T are configured such that the glass upper edge 20 is in contact with the glass 12 of the body container top 10T. The top 10T of the container is provided with an inner laminated layer 18T of plastic that is generally transparent along with the glass 12 for window 13.

Various predominantly plastic (reclaimed plastic) body containers including the embodiments described include caskets, coffins, sacrophagues, mummy shaped containers etc., produced from primarily plastic and other materials. While all the plastic can be new virgin plastic in most instances it can, advantageously, be reclaimed plastic even chemically contaminated plastic except for some medically contaminated and/or radioactive plastic material. The containers may be clear or opaque and have various designs included and have see through windows making opening of the container containing a body unnecessary, and the containers can be made air tight such that neither air or gas enter or escape a container. Non porous glass sheets or glass matting is used as a liner in a sealed container with a further liner of plastic useable to protect the inner surface of the glass sheets or glass matting used thereon. A suitable adhesive is used between the box and box top and in laminations involved.

The plastic cadaver container in the form of a casket 10C in FIGS. 5, 6 and 7 also made primarily of plastic (may be reclaimed plastic) is shown to have a top 10T' equipped with a viewing window 13'. The top 10T' is shown to be broken away to show an innermost layer of satin 21 (or any fine fabric used to be the innermost lining of a casket) within a plastic internal sheet box 18'. The casket top 10T' may be openable on a side hinge (detail not shown) in a conventional manner. Further, the casket 10C is shown in FIGS. 6 and 7 to have opposite side handle rods 22L and 22R interconnected by bottom straps 23A–D and to have an emblem 14A'.

Whereas this invention has been described with respect to several embodiments thereof it should be realized that various changes may be made without departure from the essential contributions to the art made by the teachings hereof.

I claim:

1. A plastic cadaver container molded as a product produced from primarily plastic, comprising: a plastic outer container; a non porous material container contained within said plastic outer container; a plastic lid for said plastic outer container; a layer of non porous material on the bottom of said lid; a protective layer of plastic is laminated to the inside of said non porous material porous material container and to the inside of said non porous material on the bottom of said lid; and wherein said non porous material container is glass.

2. The plastic cadaver container of claim 1, wherein said non porous material on the bottom of said lid is glass.

3. The plastic cadaver container of claim 1, wherein glass of the non porous material container is in contact with glass on the bottom of said lid when the lid is in place on said non porous material container.

4. The plastic cadaver container of claim 3, wherein said glass is in the form of glass sheeting.

5. The plastic cadaver container of claim 3, wherein said glass is in the form of glass matting.

6. The plastic cadaver container of claim 2, wherein glass of the non porous material container is in contact with glass on the bottom of said lid when the lid is in place on said non porous material container.

7. The plastic cadaver container of claim 6, wherein said glass is in the form of glass sheeting.

8. The plastic cadaver container of claim 6, wherein said glass is in the form of glass matting.

9. The plastic cadaver container of claim 3, wherein said plastic cadaver container is provided with a viewing window for viewing a cadaver occupant of said container.

10. The plastic cadaver container of claim 9, wherein emblem showing is embedded in said plastic of the container.

11. The plastic cadaver container of claim 9, wherein said plastic of the container is transparent.

12. The plastic cadaver container of claim 3, wherein additional plastic is introduced within said container to surround a cadaver contained within said container.

* * * * *